US005695439A

United States Patent [19]

Lin

[11] Patent Number: 5,695,439

[45] Date of Patent: Dec. 9, 1997

[54] ROTATABLE EXERCISER

[76] Inventor: Chang Yu Lin, P.O. Box 65-76, Taichung, Taiwan

[21] Appl. No.: 705,168

[22] Filed: Aug. 29, 1996

[51] Int. Cl.[6] ..... A63B 22/14; A63B 23/08; A63B 23/10

[52] U.S. Cl. ..... 482/146; 482/147; 482/79

[58] Field of Search ..... 482/145–148, 482/54, 52, 57, 71, 79

[56] References Cited

U.S. PATENT DOCUMENTS

| | | | |
|---|---|---|---|
| 4,406,451 | 9/1983 | Gaetano | 482/54 |
| 4,846,463 | 7/1989 | Kleinnibbelink | 482/71 |
| 4,953,858 | 9/1990 | Zelli | 482/147 |
| 5,078,389 | 1/1992 | Chen | 482/147 |
| 5,366,430 | 11/1994 | Yao | 482/147 |
| 5,407,408 | 4/1995 | Wilkinson | 482/54 |
| 5,529,554 | 6/1996 | Escehnbach | 482/70 |

*Primary Examiner*—Richard J. Apley
*Assistant Examiner*—Denise Pothier

[57] ABSTRACT

An exerciser includes a pivot shaft disposed in a base. A lever has one end rotatably secured to the pivot shaft for allowing the lever to be rotated about the pivot shaft. The lever has a pivot axle disposed to the other end. A foot support is rotatably secured to the pivot axle for allowing the foot support to be rotated about the pivot axle. The foot support includes a block secured to the pivot axle and a cover rotatably supported on the block by a number of balls such that the cover is rotatable about the block.

1 Claim, 5 Drawing Sheets

ROTATABLE EXERCISER

BACKGROUND OF THE INVENTION

1. Field of the Invention

The present invention relates to an exerciser, and more particularly to a rotatable exerciser.

2. Description of the Prior Art

One typical rotatable exerciser comprise a foot support rotatably supported about a base for supporting a user thereon. The user may stand on and rotate the foot support for conducting rotating exercises. The foot support may be rotated about the center axis thereof only and may not be moved by other motion.

The present invention has arisen to mitigate and/or obviate the afore-described disadvantages of the conventional exercisers.

SUMMARY OF THE INVENTION

The primary objective of the present invention is to provide a rotatable exerciser which includes a support rotatable about its own axis and rotatable about another pivot shaft.

In accordance with one aspect of the invention, there is provided an exerciser comprising a base including a pivot shaft provided therein, a lever including a first end rotatably secured to the pivot shaft for allowing the lever to rotate about the pivot shaft, and the lever including a second end having a pivot axle provided therein, and a foot support rotatably secured to the pivot axle for allowing the foot support to be rotated about the pivot axle.

The base includes a front portion having a frame secured thereto, the frame includes a room provided therein, a pivot pin secured in the frame, the exerciser further includes a post having a lower portion engaged in the room of the frame, the lower portion of the post includes an oblong hole slidably engaging with the pivot pin for allowing the post to be moved upward and downward relative to the pivot pin, the post includes a handle device provided thereon.

The handle device includes a rear opening, the exerciser further includes an arm having a lower portion pivotally coupled to the base and having an upper end engaged in the rear opening of the handle device and secured to the handle device.

The foot support includes a block pivotally secured to the pivot axle for allowing the block to be rotated about the pivot axle, the block includes an upper portion having a plurality of balls provided thereon, a cover is engaged on the block and includes a plurality of orifices for engaging with the balls, the orifices include a size smaller than that of the balls for allowing the balls to be partially extended upward through the orifices and for preventing the balls from disengaging from the block.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
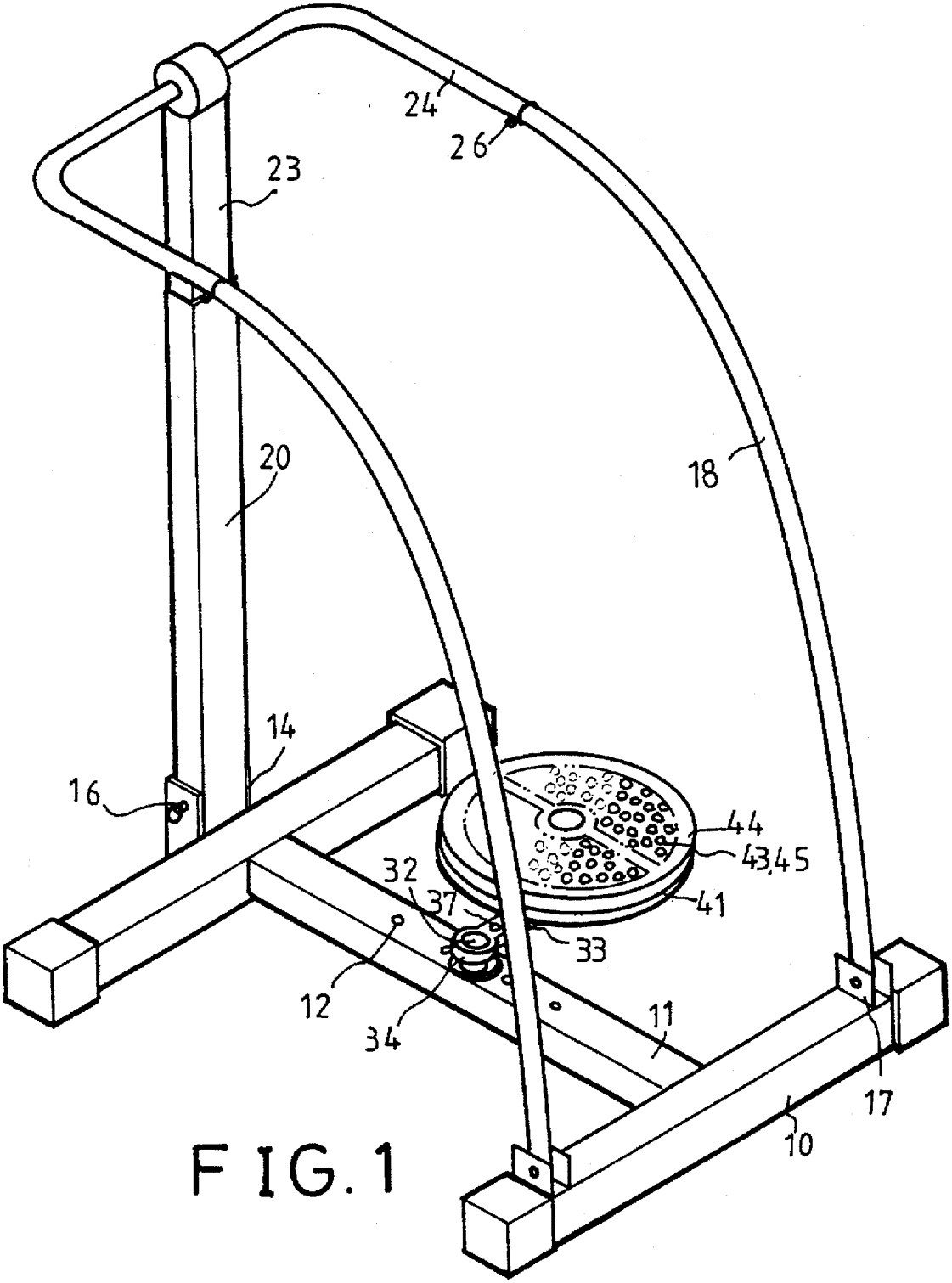
FIG. 1 is a perspective view of a rotatable exerciser in accordance with the present invention.
Figure 2:
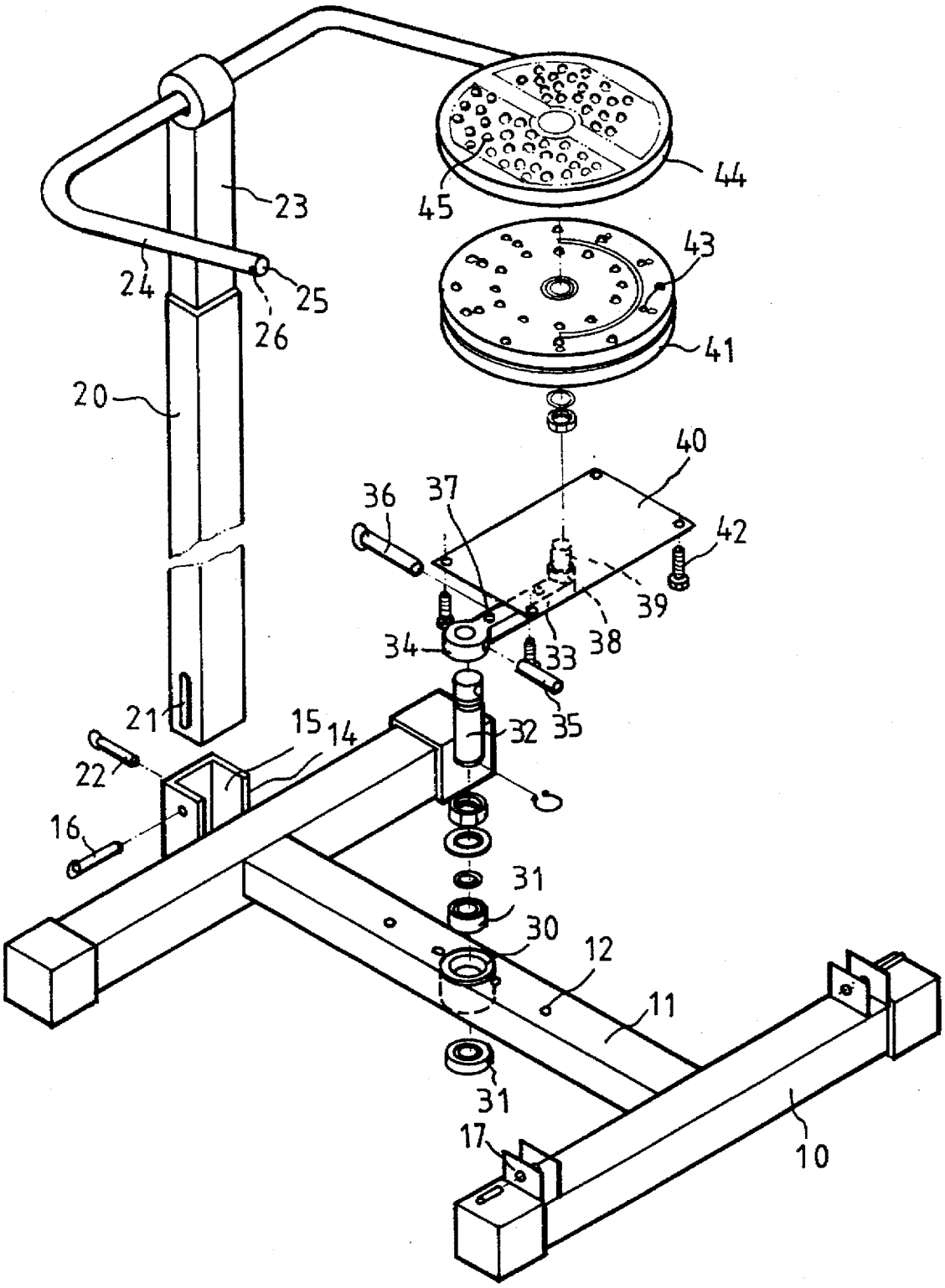
FIG. 2 is an exploded view of the rotatable exerciser.
Figure 3:
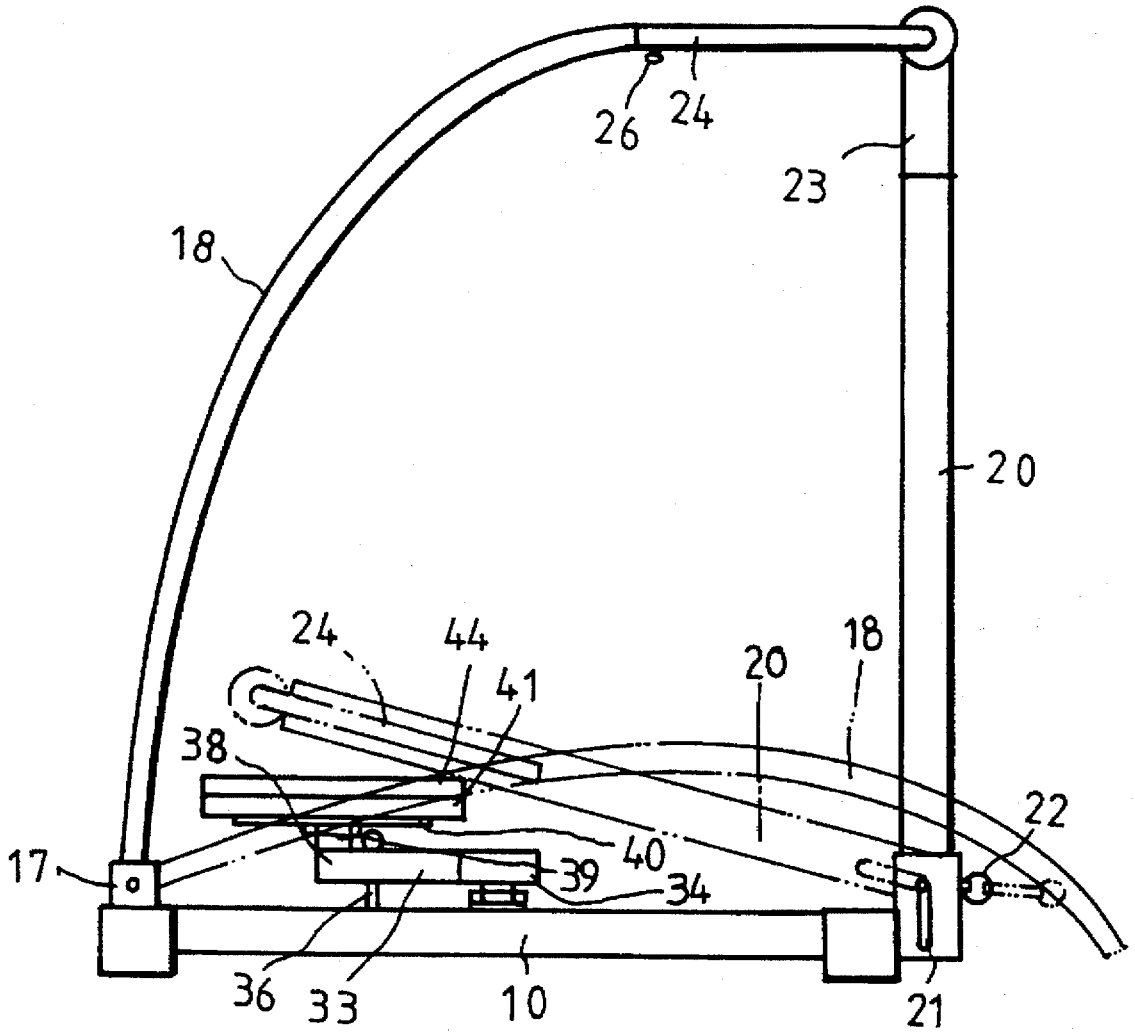
FIG. 3 is a side view of the rotatable exerciser.

Referring to the drawings, and initially to FIGS. 1 to 3, a rotatable exerciser in accordance with the present invention comprises a base 10 including a beam 11 having one or more holes 12 formed therein. The base 10 includes a frame 14 secured to the front portion and having a room 15 for engaging with the lower portion of a post 20. A pin 16 is secured in the frame 14. The post 20 includes an oblong hole 21 formed in the bottom portion for slidably engaging with the pin 16 and for allowing the post 20 to be moved slightly upward relative to the frame 14 so as to be folded to a storing configuration, as shown in dotted line in FIG. 3. A pin or a screw 22 is secured to the frame 14 for securing the lower end of the post 20 in place. The post 20 includes an extension 23 slidably engaged in the upper portion and movable upward for increasing the height of the post 20. A pair of handles 24 are secured on top of the extension 23 and each includes a rear opening 25 formed therein. The base 10 includes two pairs of lugs 17 provided on the rear portion. Two curved arms 18 each has a lower end pivotally supported in the lugs 17 and each has an upper end engaged in the rear opening 25 of the handles 24 and secured to the handles 24 by fastening screws 26.

A hub 30 is secured in the center portion of the beam 11. A pivot shaft 32 is rotatably engaged in the hub 30 by bearings 31. A lever 33 includes a ring 34 formed on one end thereof for engaging on the upper end of the pivot shaft 32 and for securing to the pivot shaft 32 by a fastening pin 35 such that the lever 33 is rotated in concert with the pivot shaft 32 and is rotatable about the longitudinal axis of the pivot shaft 32. The lever 33 includes a sleeve 38 provided in the other end distal to the pivot shaft 32, for rotatably receiving a pivot axle 39 therein. A board 40 is secured on top of the pivot axle 39. A block 41 is secured on top of the board 40 by fastening screws 42. The block 41 includes a number of balls 43 rotatably provided in the upper portion thereof. A cover 44 is engaged on the block 41 and includes a number of orifices 45 for engaging with the balls 43. The orifices 45 includes a size slightly smaller than that of the balls 43 for allowing the balls 43 to be partially extended upward through the orifices 45 and for preventing the balls 43 from disengaging from the block 41, such that the cover 44 is rotatably supported on the block 41.

It is to be noted that the block 41 and the cover 44 form a foot support for supporting the user thereon. The cover 44 is rotatable about the block 41 by the balls 43 such that the pivot axle 39 may be secured to the sleeve 38 by fastening members. The lever 33 is rotatable about the pivot shaft 32 such that the foot support formed by the block 41 and the cover 44 may also rotate about the pivot shaft 32 in addition to the self rotational movement about the pivot axle 39.

Figure 4:
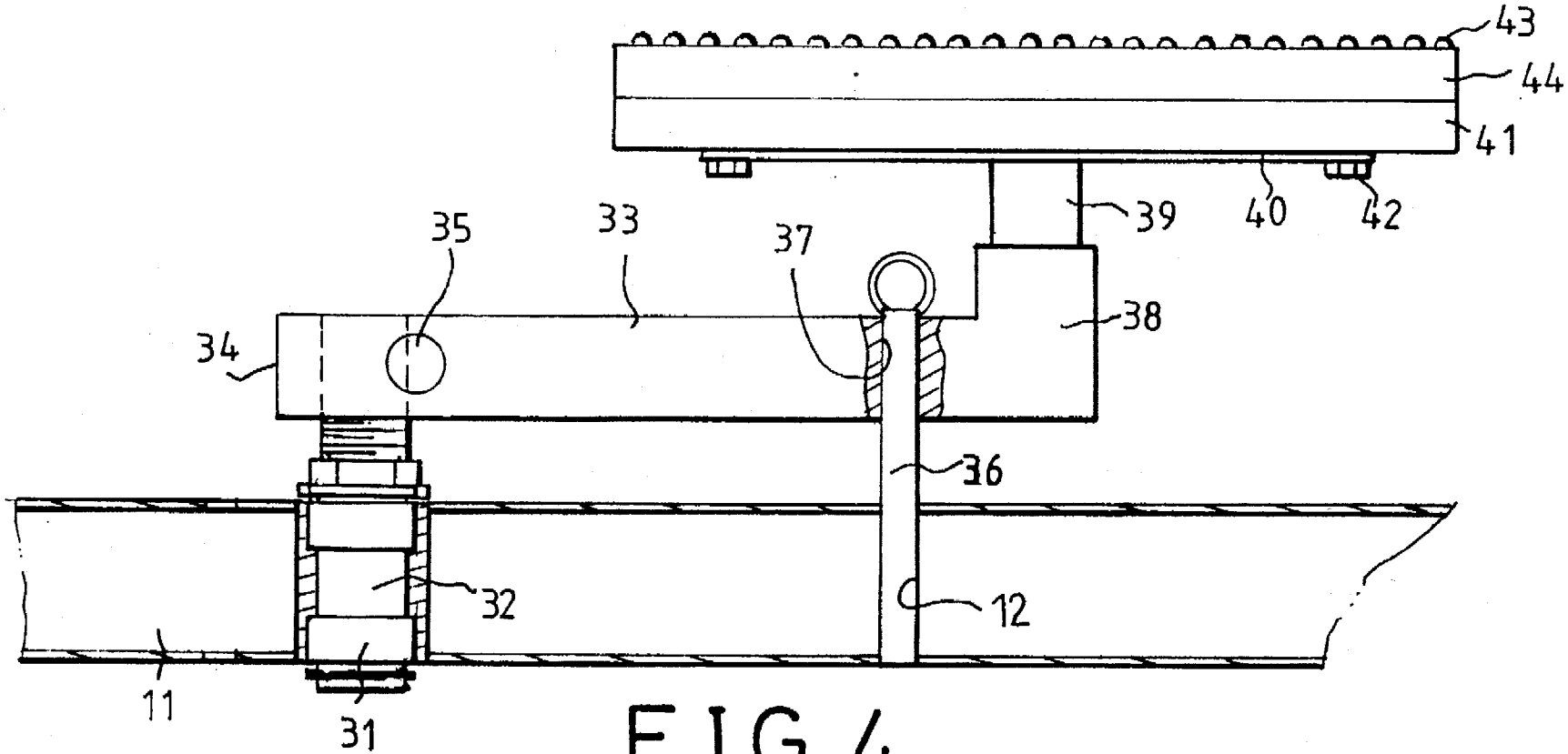
FIG. 4 is an enlarged partial side view, in which a portion of the element is shown in cross section.

Referring next to FIG. 4, a fixing pin 36 may engage through the hole 37 of the lever 33 and engaged with any of the holes 12 for securing the lever 33 to the base 10 and for preventing the lever 33 from rotating relative to the pivot shaft 32.

Figure 5:
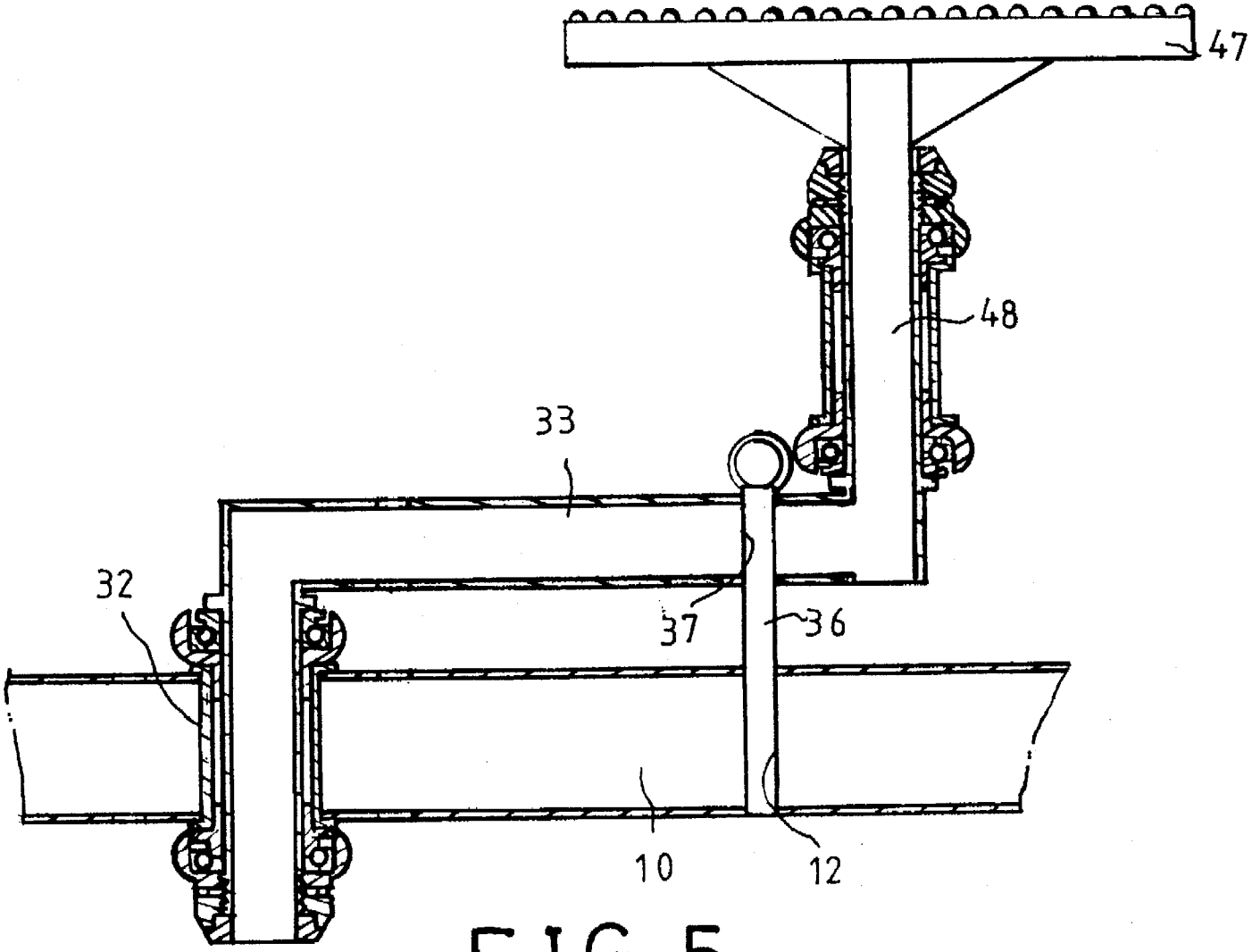
FIG. 5 is an enlarged partial cross sectional view illustrating another application of the rotatable exerciser.

Referring next to FIG. 5, a foot support 47 includes a pivot axle 48 extended downward therefrom for rotatably securing to the other end of the lever 33. The lever 33 includes a pivot shaft 32 extended downward from the other end and rotatably engaged in the base 10 such that the lever 33 is also rotatable about the pivot shaft 32 and such that the foot support 47 is also rotatable about the pivot axle 48.

Accordingly, the rotatable exerciser in accordance with the present invention includes a foot support rotatable about its own pivot axle and rotatable about a pivot shaft distal to the pivot axle.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a base including a substantially vertical pivot shaft and including a front portion having a frame, said frame including a room, a pivot pin secured in said frame, a post including a lower portion engaged in said room of said frame and having an oblong hole slidably engaging with said pivot pin for allowing said post to be moved upward and downward relative to said pivot pin, said post including an upper portion having a handle, a substantially horizontal lever including a first end rotatably secured to said pivot shaft for allowing said lever to be rotated horizontally 360 degrees about said pivot shaft, and said lever including a second end having a pivot axle provided therein, and a foot support rotatably secured to said pivot axle for allowing said foot support to be rotated about said pivot axle, said foot support including a block pivotally secured to said pivot axle for allowing said block to be rotated about said pivot axle, said block including an upper portion having a plurality of balls, a cover engaged on said block and having a plurality of orifices for engaging with said balls, said orifices including a size smaller than that of said balls for allowing said balls to be partially extended upward through said orifices and for preventing said balls from disengaging from said block.

* * * * *